US006086150A

United States Patent [19]

Scheurer et al.

[11] Patent Number: 6,086,150

[45] Date of Patent: Jul. 11, 2000

[54] FABRICATION OF VINYL COATED POOL CHAIR

[75] Inventors: Robert S. Scheurer; Michael L. Perry, both of Wichita Falls, Tex.

[73] Assignee: Texas Recreation Corporation, Wichita Falls, Tex.

[21] Appl. No.: 09/178,818

[22] Filed: Oct. 26, 1998

[51] Int. Cl.[7] ..... A47C 31/00

[52] U.S. Cl. ..... 297/219.1; 441/129; 441/130; 297/452.17; 297/452.19

[58] Field of Search ..... 297/219.1, 452.17, 297/452.19; 441/129, 130; 4/496; 114/363

[56] References Cited

U.S. PATENT DOCUMENTS

| | | | |
|---|---|---|---|
| 3,154,345 | 10/1964 | Lambrecht . | |
| 3,620,570 | 11/1971 | Wilson . | |
| 4,026,567 | 5/1977 | Rye . | |
| 4,358,866 | 11/1982 | Rhodes . | |
| 4,384,857 | 5/1983 | Hoy, Jr. | 441/130 |
| 4,435,165 | 3/1984 | Johnson | 441/130 |
| 4,484,781 | 11/1984 | Phelps . | |
| 4,662,852 | 5/1987 | Schneider et al. | 441/132 |
| 5,004,296 | 4/1991 | Ziegenfuss, Jr. . | |
| 5,052,965 | 10/1991 | Klapp et al. | 441/130 |
| 5,088,723 | 2/1992 | Simmons | 441/130 |
| 5,226,184 | 7/1993 | Cheng | 441/129 |
| 5,307,524 | 5/1994 | Schober | 4/496 |
| 5,403,220 | 4/1995 | Goad, Sr. | 441/130 |
| 5,439,405 | 8/1995 | Storey et al. . | |

*Primary Examiner*—Anthony D. Barfield
*Attorney, Agent, or Firm*—Dennis T. Griggs

[57] ABSTRACT

A buoyant lounge chair supports a swimmer in a stable, semi-reclining position while the chair is floating in a swimming pool. Interconnected rigid frame members collectively form an open chair frame. Buoyant cushions are attached to the chair frame, forming a chair seat, a chair back, left and right chair arms and a bolster block. The buoyant cushions forming the chair seat and the chair back include overlapping layers of buoyant cushion material that are secured together by adhesive, with the seat frame and the back frame being sandwiched between the overlapping layers. One of the buoyant layers forms a continuous body support surface that transitions through an angle from the chair seat to the chair back. Each arm support includes an upright arm support riser that is laterally offset from the seat frame and a horizontal arm rest segment that is vertically offset from the seat frame. A hanger coupling member in the form of a threaded nut is welded onto a central seat frame segment so that the assembled lounge chair can be suspended from an overhead hanger during the application of protective vinyl coating material.

20 Claims, 7 Drawing Sheets

FABRICATION OF VINYL COATED POOL CHAIR

BACKGROUND OF THE INVENTION

This invention relates generally to swimming pool accessories, and in particular to a buoyant lounge chair for supporting a person in a semi-reclining position while the chair is floating in water.

Swimming pools offer personal recreation and relaxation in a variety of settings, including private homes, apartment complexes, motels, resorts and country clubs. Various flotation devices including buoyant chairs, rafts, water wings, floating cushions and buoyant pool floats are used by swimmers as an aid for floating and relaxing on the surface of the water, while remaining seated upright, reclining or lounging, either partially or completely submerged. These items of pool furniture include flotation cushions made of a buoyant material such as open cell foam, closed cell foam, cork, kapok, fiberglass or balsa wood, which are sealed within a protective outer covering.

A popular item of pool furniture is the buoyant lounge chair which permits a swimmer to float on the surface of the water in a comfortable seated, reclining or lounging orientation. One limitation imposed by the construction of conventional lounge chairs is that the buoyant arm support sections are subject to tearing or deformation, and are also subject to collapse and separation from the chair frame at the interface between the arm support sections and the chair seat.

Another limitation imposed by the construction of conventional lounge chairs is in the lack of sufficient buoyancy material to maintain a stable upright orientation while the swimmer is in a reclining or lounging position. The buoyant lounge chair can overturn in response to shifting of its center of buoyancy, which occurs as the swimmer moves about while in a reclining or partially reclining orientation.

The external surface of the lounge chair is susceptible to attack by mildew, fungus, surface hardening, cracking and shrinking which occur as a result of long-term exposure to water, pool chemicals and solar radiation. Consequently, lounge chairs as well as other buoyant flotation devices are desirably protected by a coating of a durable, non-reactive plastic material, such as vinyl. The protective coating must be soft, pliable and able to withstand rough handling and high shear forces along the joinder lines between the chair arms, the chair seat and chair back.

The protective coating is applied by various processes, including dipping and spraying. According to a conventional coating process, a lounge chair to be treated with a protective coating is gripped on one end by a clamp and suspended while the protective coating is being applied to the lower section of the chair. After the protective coating has dried, the lounge chair is inverted and clamped on its opposite end to permit the untreated section of the chair to be coated. This two-step procedure requires additional labor and is generally unsatisfactory because of clamp marks and creases formed on the chair cushions which disfigure its surface appearance. Moreover, an uneven finish line is produced along the boundary of the separate protective coating layers when the lower and upper sections of the lounge chair are coated and dried separately.

BRIEF SUMMARY OF THE INVENTION

The buoyant lounge chair of the present invention supports a swimmer in a stable semi-reclining or lounging position while the chair is floating in a swimming pool. Interconnected rigid frame members collectively form an open chair frame. Buoyant cushions are attached to the chair frame, thereby forming a chair seat, a chair back, left and right chair arms and a bolster block. The buoyant cushions forming the chair seat, the chair arms, the chair back and the bolster block each include layers of buoyant cushion material secured together by an adhesive deposit in overlapping relation, with each chair frame member being captured and sandwiched between a pair of the buoyant layers.

According to one aspect of the invention, each buoyant arm support section is reinforced by an upright arm support riser that is laterally offset from the seat frame and a horizontal arm rest segment that is vertically offset from the seat frame. The left and right arm support cushions are stabilized and supported against collapse and separation from the chair frame by the upright arm support riser and the horizontal arm rest segment that are sandwiched between the buoyant arm support cushions.

According to another aspect of the invention, the upright floating stability of the lounge chair is improved by a seat frame assembly including left and right seat frame segments each including an angled connecting portion attached to a central seat frame segment, with the angled connecting portions sloping relative to the seat frame segments, whereby the buoyant cushions in combination with the seat frame segments form a leg support section that slopes downwardly relative to the chair seat.

The floating stability of the lounge chair is further improved by a similar downwardly sloping orientation of the bolster block. According to this aspect of the invention, the bolster frame includes left and right bolster frame segments that are angled downwardly from the back frame, and are sandwiched between lower and upper buoyant cushions. The bolster frame segments maintain the bolster block in a downwardly sloping orientation relative to the chair back, thus increasing the buoyant force acting on the lounge chair.

According to yet another aspect of the invention, a coupling member for suspending the lounge chair from an overhead hanger is attached to the seat frame. In the preferred embodiment, the coupling member is a threaded nut that is welded onto a central seat frame segment. According to this arrangement, the lounge chair is suspended from an overhead hanger during the application of a protective vinyl coating, thus avoiding clamp markings and finish imperfections that result from conventional finishing techniques.

BRIEF DESCRIPTION OF THE DRAWING

The accompanying drawing is incorporated into and forms a part of the specification to illustrate the preferred embodiments of the present invention. Various advantages and features of the invention will be understood from the following detailed description taken in connection with the appended claims and with reference to the attached drawing figures in which:

DETAILED DESCRIPTION OF THE INVENTION

Figure 1:
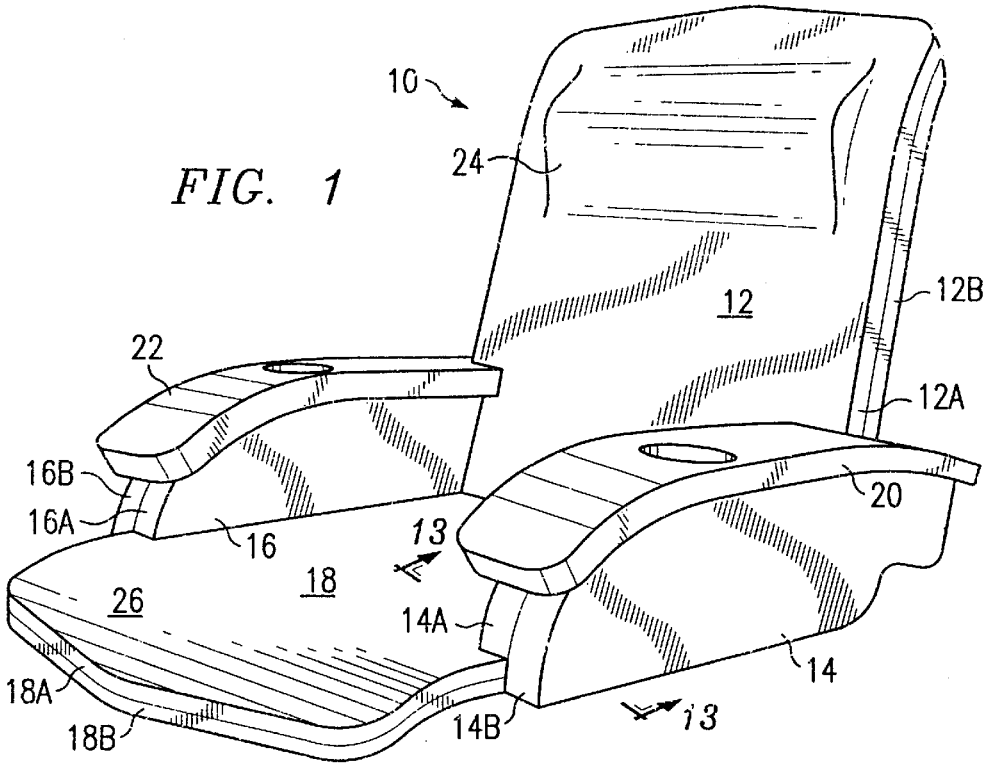
FIG. 1 is perspective view of a buoyant lounge chair constructed according to the present invention.

Preferred embodiments of the invention will now be described with reference to various examples of how the invention can best be made and used. Like reference numerals are used throughout the description and several views of the drawing to indicate like or corresponding parts.

Figure 12:
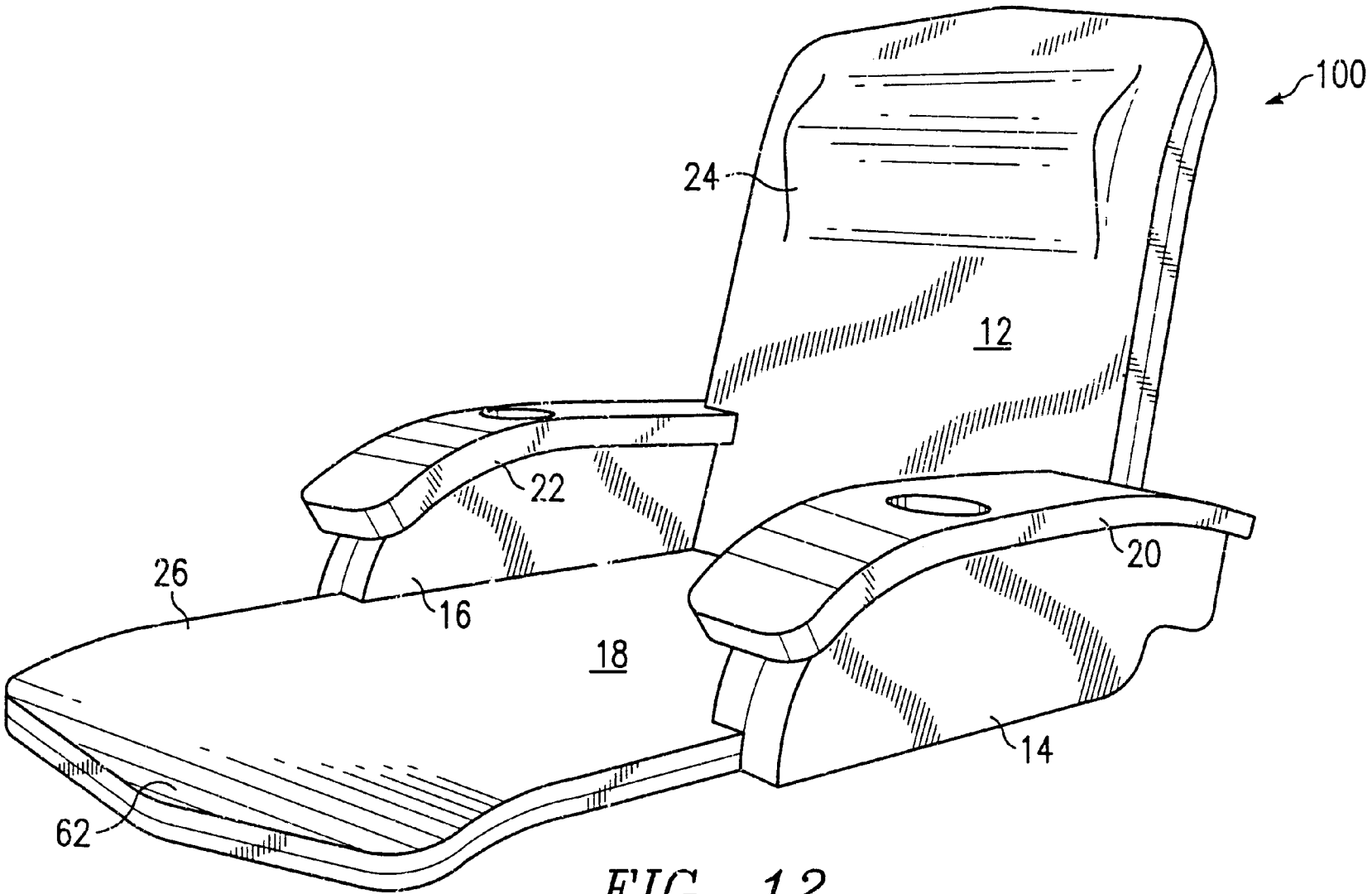
FIG. 12 is a perspective view of a lounge chair having an extended leg support section.

Referring now to FIG. 1–FIG. 6, there is illustrated an exemplary embodiment of a light-weight buoyant lounge chair 10 for supporting a person in seated and semi-reclining lounge positions while the chair is floating in an upright operative position in water, substantially as indicated in FIG. 1 and FIG. 12. The lounge chair 10 includes a chair back 12, chair arms 14, 16, a chair seat 18 and arm rest cushions 20, 22 which provide full body support in the seated, reclining and semi-reclining lounge positions.

The operative upright floating position refers to the flotation orientation of the lounge chair 10 with the chair back 12 and chair arms 14, 16 generally upright while the chair seat 18 is generally horizontal and at least partially submerged. When the lounge chair is floating in water, the occupant is supported in a comfortable lounging orientation, with his arms being supported by the left arm rest cushion 20, the right arm rest cushion 22 and his head is supported by a head support cushion 24. The occupant's legs are supported by a leg support section 26 which projects forwardly from the chair seat 18.

Figure 2:
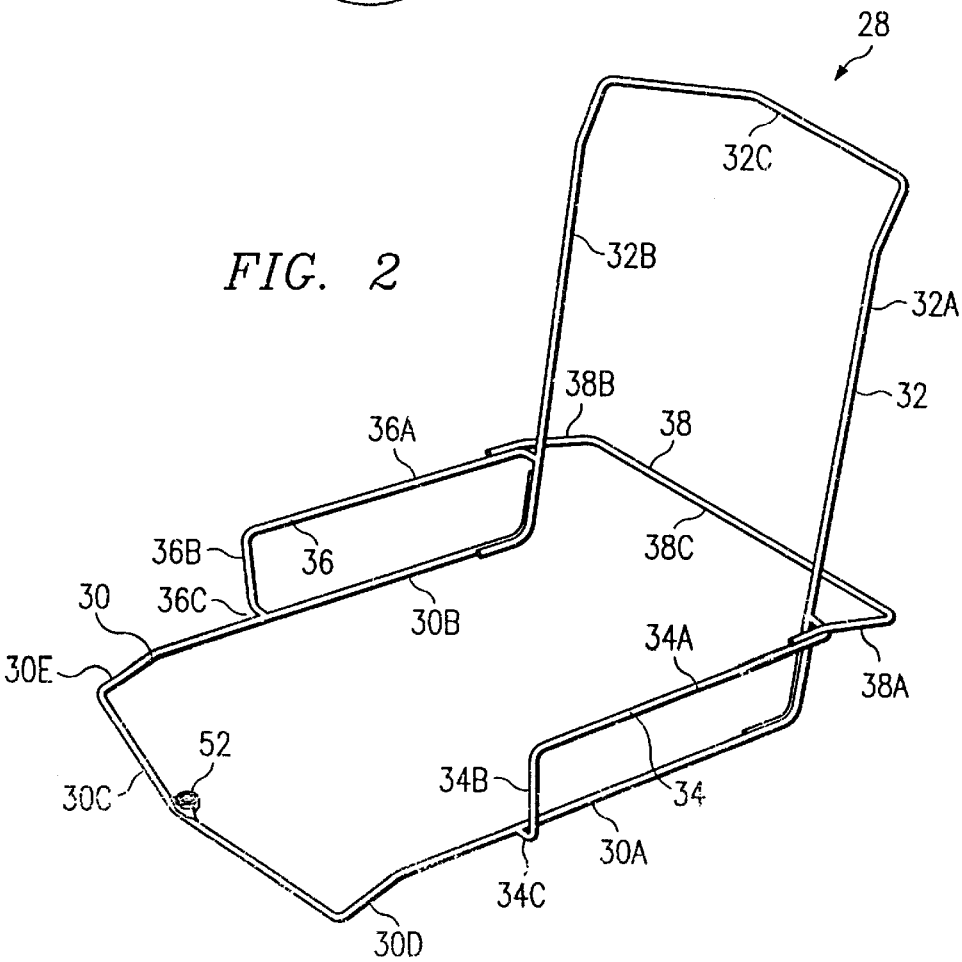
FIG. 2 is a perspective view showing interconnected rigid frame members collectively forming an open chair frame.
Figure 3:
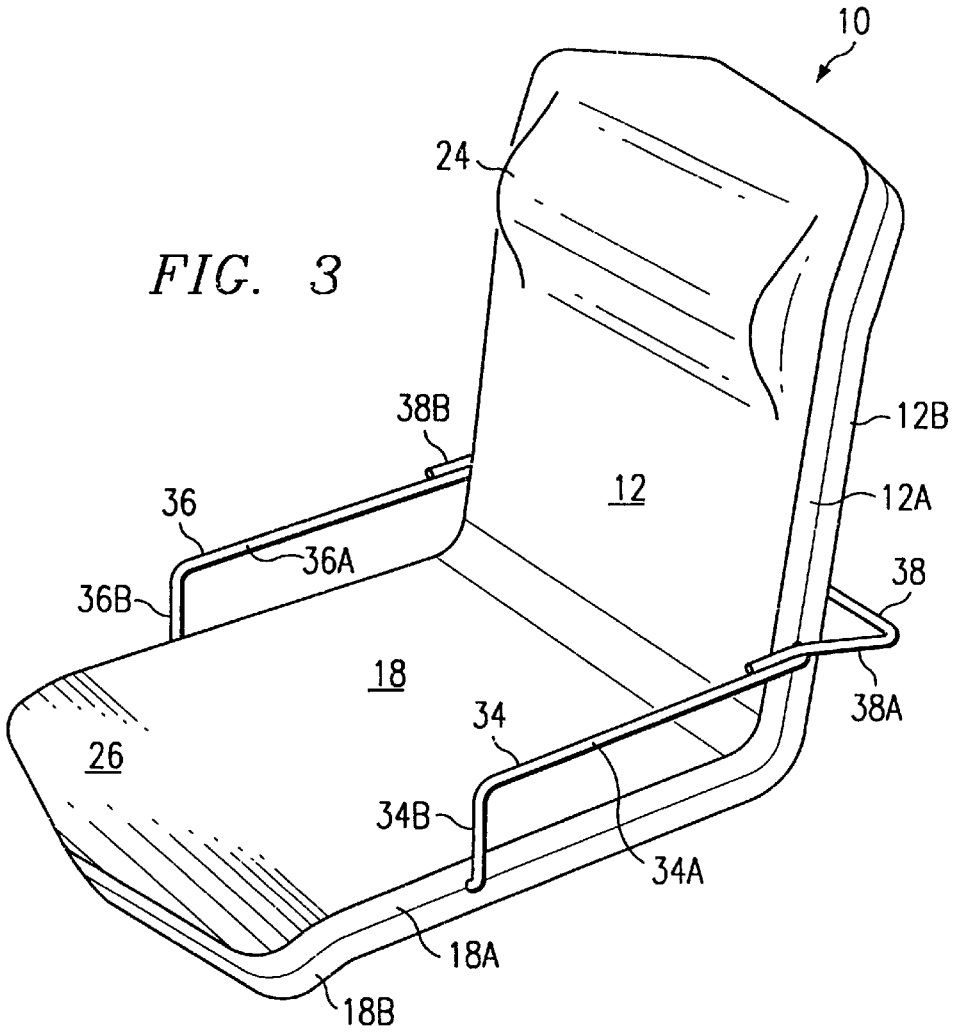
FIG. 3 is a perspective view showing first and second layers of buoyant cushion material secured together in overlapping relation, with the seat frame and back frame of the chair being sandwiched between the buoyant layers, the top layer forming a continuous body support surface that transitions through an angle between the chair seat and the chair back.
Figure 4:
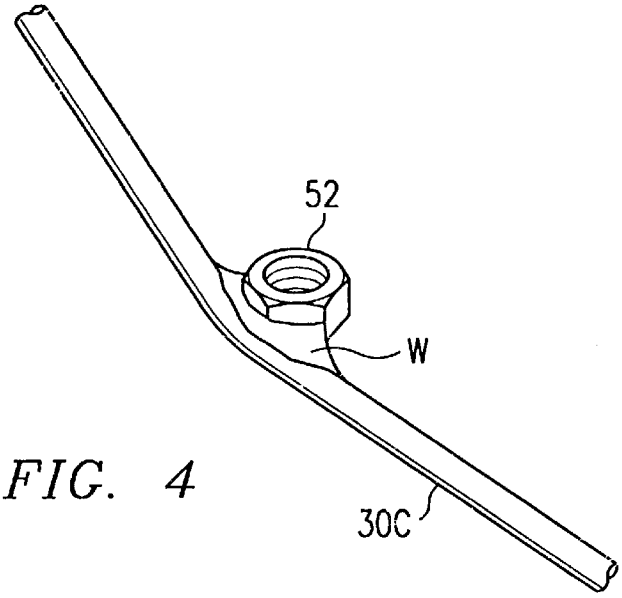
FIG. 4 is a perspective view of a portion of the seat frame, showing a threaded coupling nut welded onto the central seat frame segment.

Buoyancy sufficient to support an adult occupant having a body weight up to 250 lbs. is provided by multiple pairs of overlapping buoyant cushions that are attached to an open chair frame 28 shown in FIG. 2. The open chair frame 28 is a skeleton frame formed by interconnected rigid frame members, preferably 5/16 inch diameter steel rod segments that are welded together. The rigid steel rod segments form a seat frame 30, a back frame 32 attached to the seat frame and extending generally orthogonally with respect thereto, a left arm frame 34 and a right arm frame 36 attached to the seat frame and to the back frame, and a bolster frame 38 attached to the left and right chair arms, and offset from the chair frame and extending substantially from the left side to the right side of the chair frame 28.

Buoyant cushions formed by overlapping layers of buoyant cushion material are attached to the individual steel rod frame members, thereby forming the chair back 12, the left chair arm 14, the right chair arm 16, the chair seat 18 and a bolster block 40. Each buoyant cushion is formed by a pair of overlapping layers of buoyant material, preferably slabs of closed cell polyurethane foam F having a density of 1–6 lbs./cu.ft. The closed cell foam layer is protected and sealed by a water-resistant vinyl coating 44. Each closed cell foam layer is in the form of a rectangular slab, having a typical thickness of 1½ inch, and is cut to form a lounge chair having an assembled height of 27 inches, a length of 30 inches and a width of 30 inches.

Referring again to FIG. 2, FIG. 3, FIG. 5 and FIG. 6, overlapping pairs of buoyant cushions are attached and secured onto the chair frame members by an adhesive bonding agent, for example a fast setting contact cement 46, with the frame members being sandwiched and captured between the layers, thereby providing structural reinforcement for the soft, buoyant cushions. For this purpose, the chair seat 18 is formed by a pair of overlapping cushion layers 18A, 18B; the left chair arm is formed by a pair of overlapping arm support cushions 14A, 14B, with the left arm frame 34 being sandwiched and captured between the overlapping layers 14A, 14B. Likewise, the right arm 16 is formed by a pair of overlapping cushion layers 16A, 16B that are adhesively secured together with the right arm frame 36 being captured and sandwiched between the overlapping layers. The chair back 12 is also formed by overlapping cushion layers 12A, 12B which are adhesively secured together, with the back frame 32 being captured and sandwiched between the overlapping cushion layers. Additionally, the bolster block 40 is formed by overlapping buoyant cushion layers 40A, 40B that are adhesively secured together with the bolster frame 38 being captured and sandwiched between the overlapping cushion layers.

Figure 7:
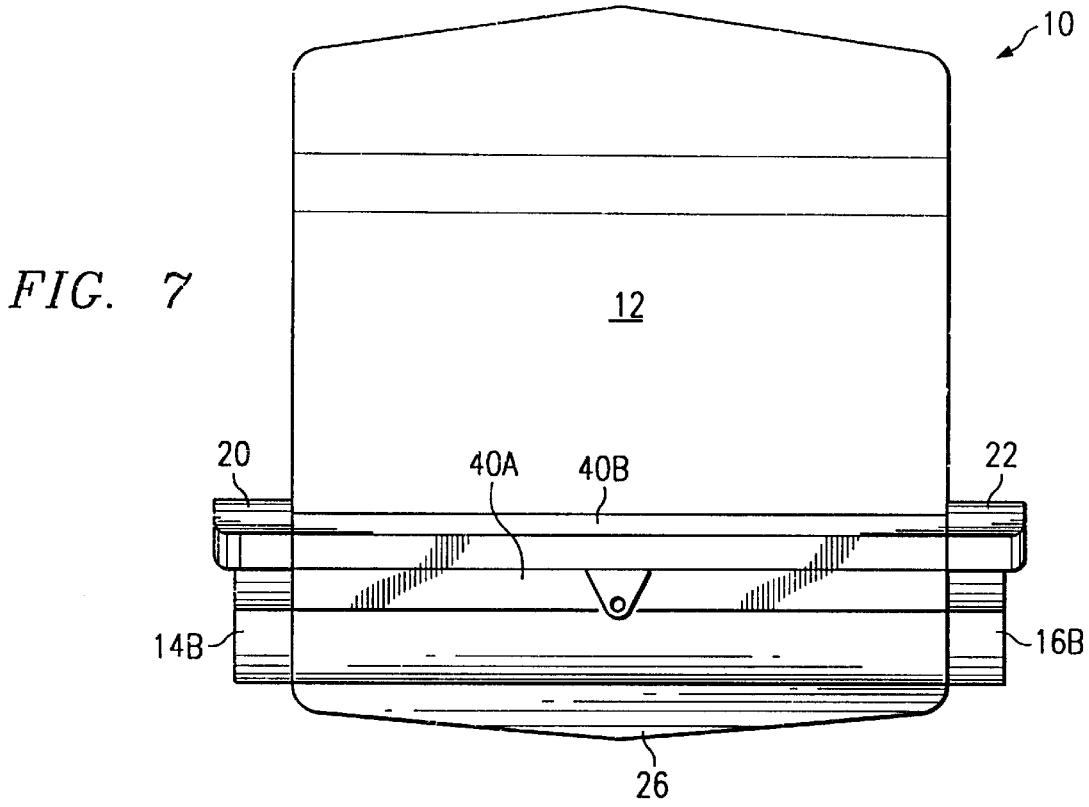
FIG. 7 is a rear elevational view of the lounge chair shown in FIG. 1.

Referring again to FIG. 1 and FIG. 5, the left and right chair arms 14, 16 are stabilized further by adhesive attachment to the top, left and right side edge portions of the chair seat 18, as well as being adhesively attached to the forward body support surface 12A and the left and right side edge portions of the chair back 12. The left and right arm support cushions are further stabilized by adhesive attachment to the left arm rest cushion 20 and right arm rest cushion 22 which bridge across the overlapping cushion layers 14A, 14B and 16A, 16B, respectively. As shown in FIG. 7, the outside buoyant layers of the left arm support 14 and right arm support 16 are adhesively attached to opposite ends of the bolster block 40 which further strengthens the arms and opposes separation of the arms from the chair seat and chair back.

The buoyant arm support sections 14, 16 are reinforced by the side arm frames 34, 36. The side arm frame 34 includes an upright arm support riser segment 34B that is laterally offset from the seat frame by an angled linking segment 34C. The side arm frame also includes a horizontal arm rest segment 34A that is vertically offset from the seat frame. The right side arm frame is identically reinforced by a horizontal arm rest segment 36A, an upright arm support riser 36B and an angled linking segment 36C attached to the seat frame 30B. The left and right arm support cushions are thus stabilized and supported against collapse and separation from the chair frame by the rigid support provided by the left and right arm segments that are sandwiched between the buoyant arm support cushions, as indicated in FIG. 13.

The upright floating stability of the lounge chair 10 is improved by the seat frame assembly 30 which includes left and right seat frame segments 30A, 30B and a central seat frame segment 30C. The central seat frame segment 30C is connected on opposite ends to the seat frame side segments by angled connecting segments 30D, 30E. The seat frame segments are captured and sandwiched between the buoyant chair seat cushions 18A, 18B. The floating stability of the lounge chair is improved by the leg support section 26 that slopes downwardly from the chair seat 18, as shown in FIG. 1. The downward slope is provided by the angled seat frame segments 30D, 30E, as shown in FIG. 2.

Figure 5:
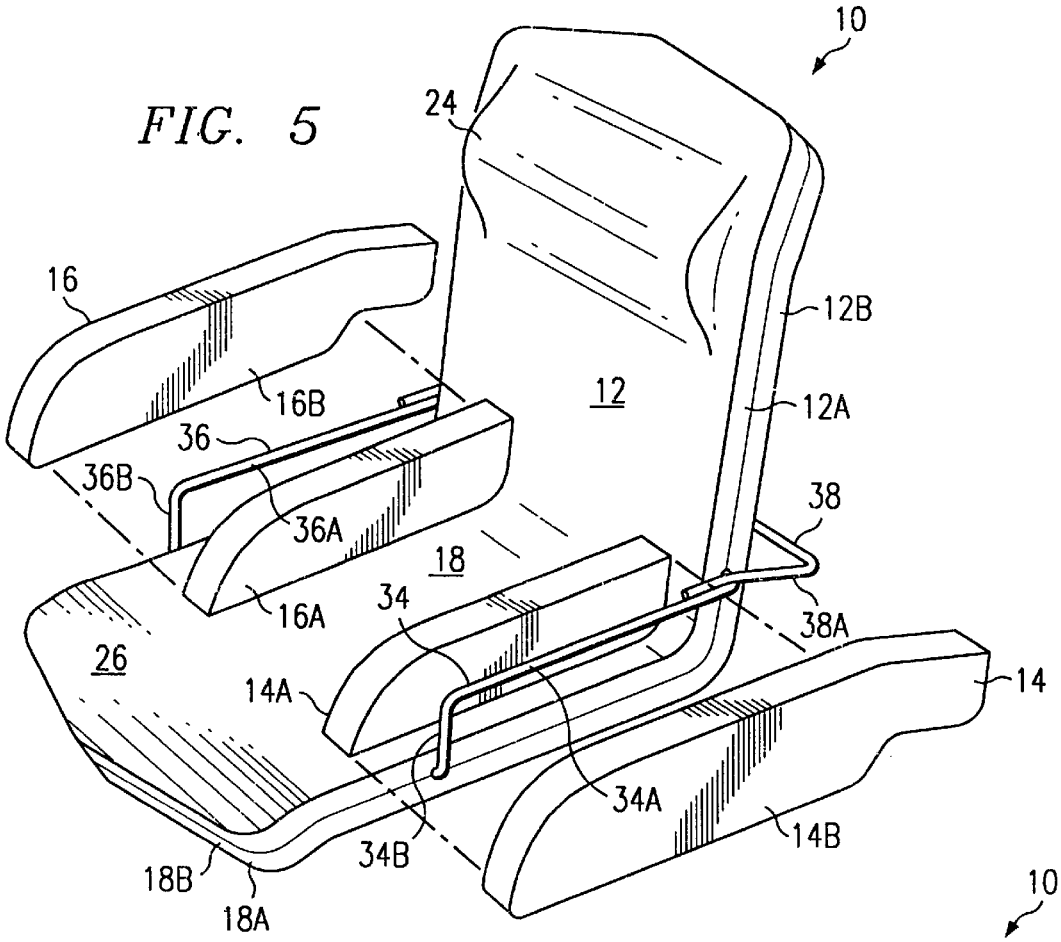
FIG. 5 is a perspective view similar to FIG. 3, showing the assembly of buoyant arm support cushions onto left and right arm frames.
Figure 6:
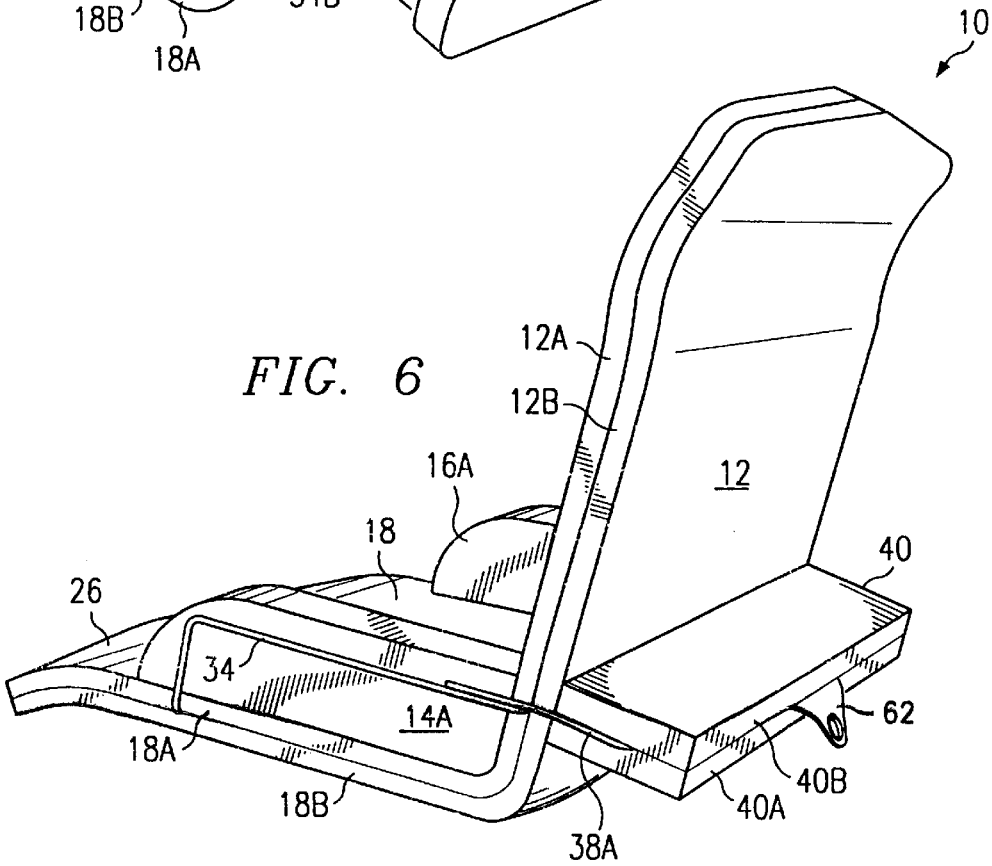
FIG. 6 is a rear perspective view of the lounge chair showing a bolster frame sandwiched between a pair of buoyant cushions.

The floating stability of the lounge chair is further improved by a similar downwardly sloping orientation of the bolster block 40. Referring to FIG. 2, FIG. 5 and FIG. 6, the bolster frame 38 includes left and right bolster frame segments 38A, 38B that are angled downwardly from the back frame 32, and are sandwiched between the lower and upper buoyant bolster cushions 40A, 40B. The bolster frame segments 38A, 38B maintain the bolster block 40 in a downwardly sloping orientation relative to the chair back when the lounge chair is in the upright floating position. Preferably, the bolster frame segments 38A, 38B slope downwardly so that the bolster block 40 is inclined by about 200 relative to the horizontal arm support segments 34A, 36A when the lounge chair is in the operative floating position.

Figure 13:
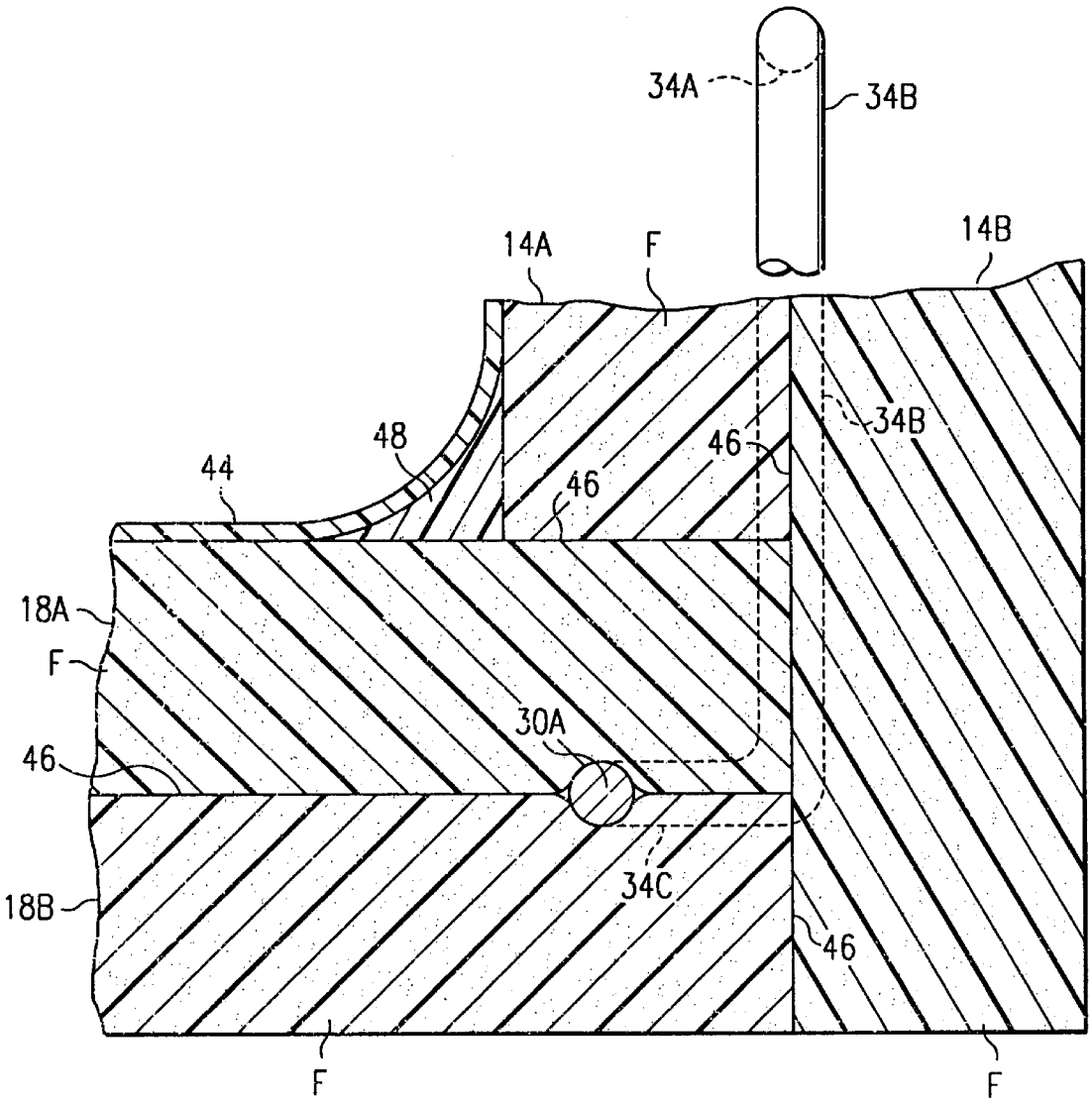
FIG. 13 is a sectional view partially broken away, taken along the line 13—13 of FIG. 1, of abutting cushion layers that are sealed within a vinyl coating.

Referring now to FIG. 1 and FIG. 13, the overlapping buoyant cushions are adhered together by a thin layer of adhesive 46. Additionally, the surface portions of the buoyant cushions bordering the lines of abutting engagement between the chair seat, the left and right chair arms, the chair back and the bolster block are further bonded together and sealed by a layer of flexible caulking material 48. Preferably, the caulking material is a high grade, 15–25 year acrylic material that provides good adhesion to the surface of the closed cell foam, and can withstand high shear forces along the joinder lines. After the caulking material 48 has been applied and cured, a layer of solvent-based vinyl coating material 44 is applied to the exposed external surfaces of the lounge chair.

Referring now to FIG. 2, FIG. 4, FIG. 8, FIG. 9 and FIG. 10, the lounge chair 10 is supported by a hanger bar 50.

Figure 8:
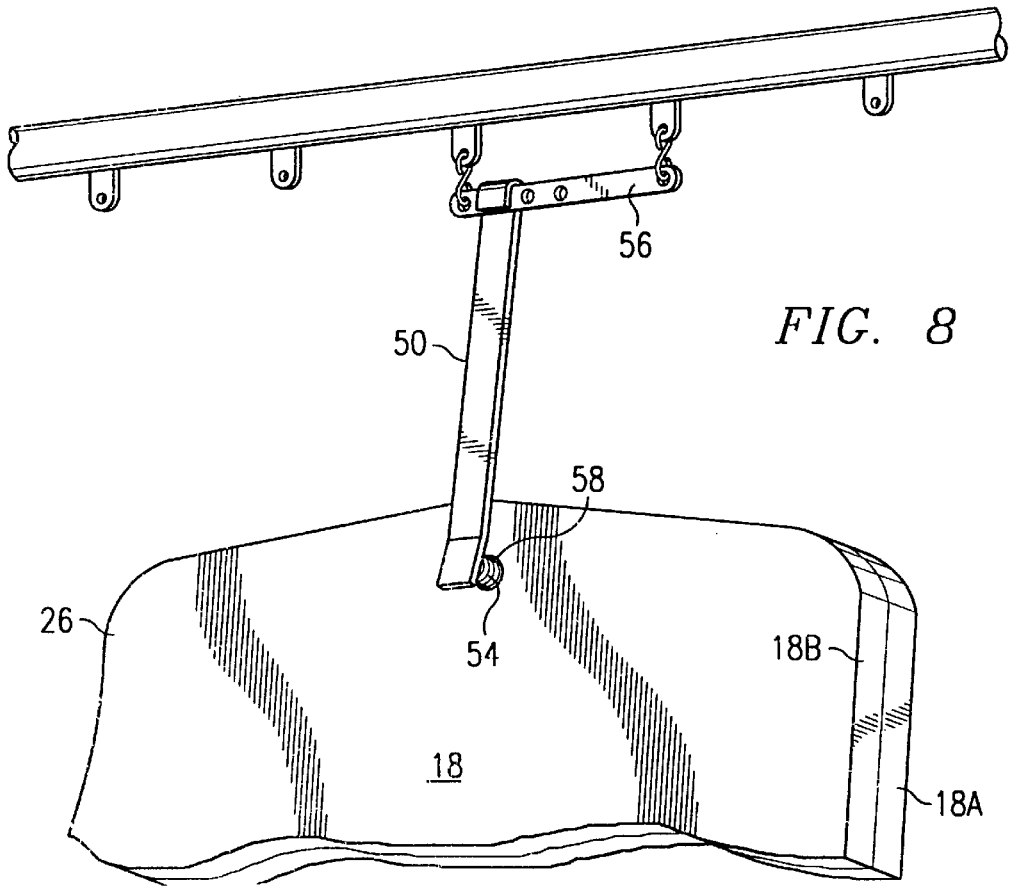
FIG. 8 is a perspective view, partially broken away, showing the lounge chair suspended from an overhead hanger prior to the application of vinyl coating.
Figure 9:
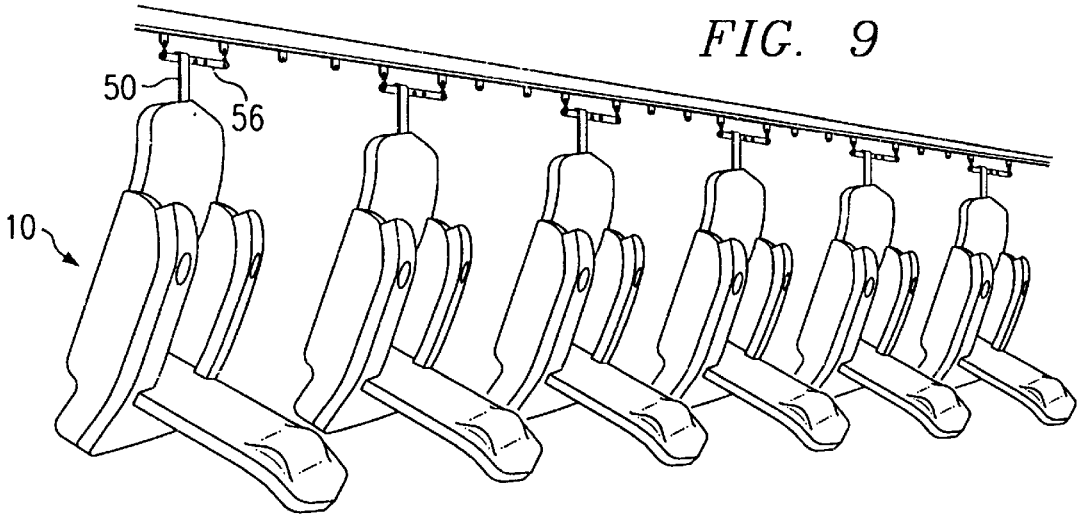
FIG. 9 is a perspective view of an assembly line showing multiple chairs being suspended by hangers while being transported to a finishing station.
Figure 10:
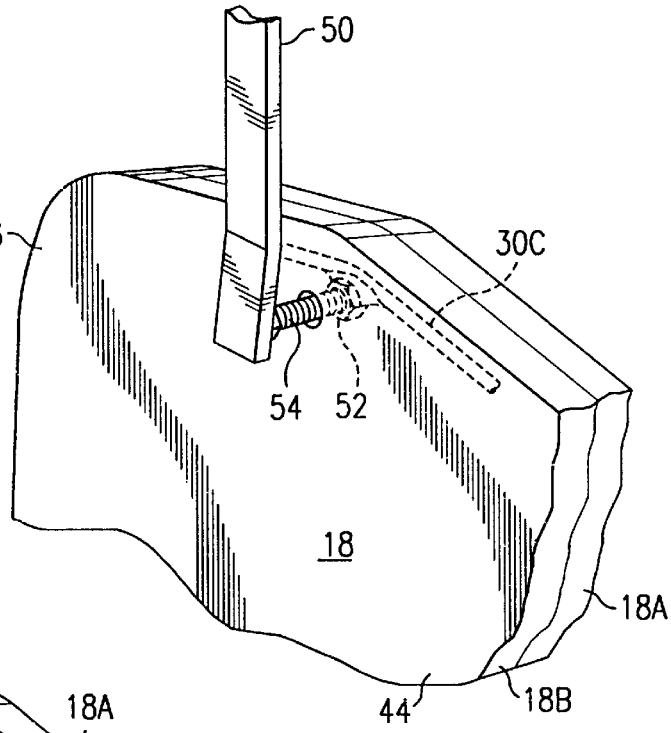
FIG. 10 is a perspective view, partially in phantom, showing the connection of the hanger to the coupling nut.
Figure 11:
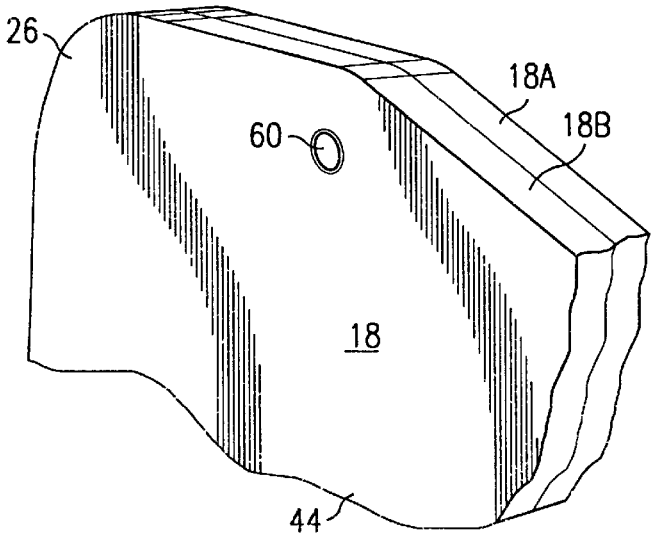
FIG. 11 is a perspective view, partially broken away, of the leg support section of the lounge chair, showing the coupling aperture plugged and ready for coating.

According to an important feature of the present invention, a protective vinyl coating 44 is applied over the external surfaces of the lounge chair 10 while it is suspended in an upside down orientation from a hanger strap 50 as shown in FIG. 8, FIG. 9 and FIG. 10. As can best be seen in FIG. 2 and FIG. 4, a hanger coupling member in the form of a threaded nut 52 is attached to the central seat frame segment 30C by a weld W. A threaded connecting rod 54 is welded onto the lower end of the hanger bar 50, and is manually threaded into the coupling nut 52.

Although the coupling nut 52 is preferably attached to the central seat frame segment 30C, it may also be attached to other steel frame segments, for example to the back frame central segment 32C.

Access to the threaded coupling nut 52 is provided by a small diameter hole 58 formed through the lower buoyant cushion layer 18B of the chair seat 18. The threaded coupling rod 54 is inserted through the access opening 58 and the hanger strap 50 is rotated clockwise to produce threaded engagement of the connecting rod 54 with the coupling nut 52. After a good threaded connection has been established, the lounge chair 10 is manually lifted and the hanger strap 50 is hung from the conveyor bar 56 for transport to a finishing station where the protective vinyl coating is applied.

After the protective vinyl coating 44 has dried, the hanger strap 50 is removed from the conveyor bar, and the hanger strap is then separated from the lounge chair by manually reversing out the threaded connecting rod 54. The access opening 58 is then sealed with a wear-resistant plug 60 of epoxy material. This method of suspending the lounge chair and then sealing the access hole leaves no visible marks, and the vinyl coating can be applied during a single operation, thus substantially reducing finished time.

Referring again to FIG. 3, the buoyant cushions forming the chair seat and the chair back are preferably formed by first and second layers of buoyant cushion material 18A, 18B that are bonded together in overlapping relation by an adhesive deposit 46 (FIG. 13). According to this arrangement, the layers of buoyant cushion material forming the chair seat 18 and the chair back 12 are integrally formed together, with the seat frame 30 and the back frame 32 being captured and sandwiched between the overlapping layers. The top buoyant layer 18A forms a continuous body support surface that transitions through an angle of approximately 90° from the chair seat 18 to the chair back 12.

Referring again to FIG. 2 and FIG. 6, a flexible tie-off grommet 62 is attached to the bolster frame 38. The tie-off grommet 62 is sandwiched and captured between the lower and upper bolster layers 40A, 40B of buoyant material. An externally projecting portion of the tie-off grommet includes an eyelet for attachment to a tether line whereby the lounge chair 10 can be secured to a fixed structure such as a pool ladder so that the lounge chair will not be blown away during high winds. Also, the tie-off grommet can be used to hang the lounge chair from an overhead hook for inside storage.

Referring now to FIG. 12, the leg support section 26 includes an extended leg support section 62 that projects forward of and in cantilevered relation to the central seat frame segment 30C. The extended length of the leg support section provides complete support for the swimmer's entire body, including his legs and feet. The lounge chair 100 shown in FIG. 12 is identical in construction with the lounge chair 10 shown in FIG. 1, except for the additional leg support length.

Although the invention has been described with reference to certain exemplary arrangements, it is to be understood that the forms of the invention shown and described are to be treated as preferred embodiments. Various changes, substitutions and modifications can be realized without departing from the spirit and scope of the invention as defined by the appended claims.

What is claimed is:

1. A lounge chair for supporting a person in a seated or semi-reclining position while the chair is floating in water, comprising:

interconnected rigid frame members collectively forming an open chair frame;

the rigid frame members including a seat frame; a back frame attached to the seat frame and extending transversely with respect thereto; a left arm frame and a right arm frame attached to the seat frame and to the back frame; and a bolster frame offset from the back frame and extending substantially from the left side to the right side of the chair frame; and, buoyant cushions attached to the rigid frame members, the buoyant cushions forming a chair seat, a chair back, left and right chair arms and a bolster block.

2. A lounge chair as set forth in claim 1, the buoyant cushions including:

a first pair of buoyant cushions attached to the chair frame, with the seat frame being sandwiched between the buoyant cushions of the first pair;

a second pair of buoyant cushions attached to the chair frame, with the back frame being sandwiched between the buoyant cushions of the second pair;

a third pair of buoyant cushions attached to the chair frame, with the left arm frame being sandwiched between the buoyant cushions of the third pair;

a fourth pair of buoyant cushions attached to the chair frame, with the right arm frame being sandwiched between the buoyant cushions of the fourth pair; and, a fifth pair of buoyant cushions attached to the chair frame, with the bolster frame being sandwiched between the buoyant cushions of the fifth pair.

3. A lounge chair for supporting a person in a seated or semi-reclining position while the chair is floating in water, comprising:

interconnected rigid frame members collectively forming an open chair frame;

the rigid frame members including a seat frame; a back frame attached to the seat frame and extending transversely with respect thereto; a left arm frame and a right arm frame attached to the seat frame and to the back frame; and a bolster frame offset from the back frame and extending substantially from the left side to the right side of the chair frame;

buoyant cushions attached to the rigid frame members, the buoyant cushions forming a chair seat, a chair back, left and right chair arms and a bolster block;

the left arm frame including an arm support riser that is laterally offset from the seat frame and an arm rest segment that is vertically offset from the seat frame; and, the right arm frame including an arm support riser that is laterally offset from the seat frame and an arm rest segment that is vertically offset from the seat frame.

4. A lounge chair as set forth in claim 3, the buoyant cushions forming the chair seat and the chair back comprising first and second layers of buoyant cushion material that are secured together in overlapping relation, with the seat frame and the back frame being sandwiched between the first and second layers, and one of the layers forming a continuous body support surface that transitions through an angle from the chair seat to the chair back.

5. A lounge chair as set forth in claim 3, including a hanger coupling member attached to one of the rigid frame members.

6. A lounge chair as set forth in claim 5, the hanger coupling member comprising a threaded nut welded onto said one of the rigid frame members.

7. A lounge chair as set forth in claim 3, the seat frame including left and right seat frame segments and a central seat frame segment connecting the left seat frame segment to the right seat frame segment, the left and right seat frame segments each including an angled connecting portion attached to the central seat frame segment, and the angled connecting portions sloping relative to the left and right seat frame segments, respectively, whereby the buoyant cushions in combination with the seat frame segments forming a leg support section that slopes downwardly relative to the chair seat when the lounge chair is in the floating position.

8. A lounge chair as set forth in claim 7, the buoyant cushions forming the chair seat and the leg support section including first and second layers of buoyant cushion material that are secured together in overlapping relation with the left and right seat frame segments, the central seat frame segment and the angled connecting portions being sandwiched between the first and second layers, and one of the layers forming a continuous body support surface that transitions through an angle from the chair seat to the leg support section.

9. A lounge chair as set forth in claim 3, the seat frame including left and right seat frame segments;

the back frame including left and right back frame segments attached to the left and right seat frame segments, respectively; and, the bolster frame including left and right bolster frame segments projecting from the left and right back frame segments, respectively, and a central bolster frame segment extending between the left and right bolster frame segments, the left and right bolster frame segments sloping with respect to the back frame segments.

10. A lounge chair as set forth in claim 3 including flexible caulking material applied to abutting portions of the buoyant cushions which form the chair seat, the left and right chair arms, the chair back and the bolster block.

11. A lounge chair as set forth in claim 3, including:

a flexible tie-off grommet attached to the bolster frame and projecting from the bolster block.

12. A lounge chair as set forth in claim 3, the seat frame including left and right seat frame segments and a central seat frame segment linking the left and right seat frame segments; and, the buoyant cushions forming the chair seat including first and second layers of buoyant cushion material that are secured together in overlapping relation, with the seat frame segments being sandwiched between the first and second layers thereby forming a leg support section, the leg support section including an extended leg support section projecting forward of and in cantilevered relation to the central seat frame segment.

13. A lounge chair as set forth in claim 3, the buoyant cushions forming the left chair arm comprising first and second layers of buoyant cushion material that are secured together in overlapping relation, with the left arm frame being sandwiched between the first and second layers; and, the buoyant cushions forming the right chair arm comprising first and second layers of buoyant cushion material that are secured together in overlapping relation, with the right arm frame being sandwiched between the first and second layers.

14. A lounge chair as set forth in claim 3, including:

a left arm rest cushion mounted on the left chair arm; and, a right arm rest cushion mounted on the right chair arm.

15. A lounge chair for supporting a person in a seated or semi-reclining position while the chair is floating in water, comprising:

interconnected rigid frame members collectively forming an open chair frame;

a hanger coupling member attached to one of the rigid frame members for attaching the lounge chair to an overhead support during a coating process; and, buoyant cushions attached to the rigid frame members, the buoyant cushions forming a chair seat, a chair back, a left chair arm and a right chair arm.

16. A lounge chair for supporting a person in a seated or semi-reclining position while the chair is floating in water, comprising:

interconnected rigid frame members collectively forming an open chair frame;

a hanger coupling member attached to one of the rigid frame members; and, buoyant cushions attached to the rigid frame members, the buoyant cushions forming a chair seat, a chair back, a left chair arm and a right chair arm, the hanger coupling member comprising a threaded nut welded onto one of the rigid frame members.

17. A lounge chair as set forth in claim 16, the buoyant cushions including first and second layers of buoyant cushion material that are secured together in overlapping relation with the hanger coupling member and the rigid frame member to which it is attached being sandwiched between the first and second layers.

18. A lounge chair as set forth in claim 16, the rigid frame members including a seat frame, a back frame attached to the seat frame and a bolster frame, the bolster frame being offset from the back frame and extending substantially from the left side to the right side of the chair frame; and, the buoyant cushions including first and second bolster layers of buoyant cushion material that are secured together in overlapping relation, with the bolster frame being sandwiched between the first and second bolster layers.

19. A lounge chair as set forth in claim 18, including:

a flexible tie-off grommet attached to the bolster frame, the tie-off grommet being sandwiched between the first and second bolster layers and projecting from the bolster block.

20. A lounge chair as set forth in claim 16, including flexible caulking material applied to abutting marginal portions of the buoyant cushions which form the chair seat, the left and right chair arms, and the chair back.

* * * * *